US009040473B1

(12) United States Patent
Quah et al.

(10) Patent No.: US 9,040,473 B1
(45) Date of Patent: May 26, 2015

(54) LOW FOAM MEDIA CLEANING DETERGENT WITH NONIONIC SURFACTANTS

(75) Inventors: EE Boon Quah, Gelugor (MY); Kwai Cheang Wong, Butterworth (MY); Ming Yean Liew, Bukit Mertajam (MY); Chung Lieh Chua, Sungai Petani (MY); Yasuhiro Suzuki, Bayan Lepas (MY)

(73) Assignee: WD Media, LLC, San Jose, CA (US)

( * ) Notice: Subject to any disclaimer, the term of this patent is extended or adjusted under 35 U.S.C. 154(b) by 336 days.

(21) Appl. No.: 12/841,121

(22) Filed: Jul. 21, 2010

(51) Int. Cl.

| | |
|---|---|
| ***C11D 11/00*** | (2006.01) |
| ***C11D 3/20*** | (2006.01) |
| ***C11D 17/08*** | (2006.01) |
| ***C11D 3/37*** | (2006.01) |
| ***B08B 3/12*** | (2006.01) |
| ***C11D 3/36*** | (2006.01) |
| ***C11D 3/04*** | (2006.01) |

(52) U.S. Cl.
CPC ..... *C11D 3/361* (2013.01); *C11D 3/3707* (2013.01); *C11D 3/046* (2013.01); *C11D 11/0047* (2013.01)

(58) Field of Classification Search
USPC ..... 510/165, 166, 167, 168, 170, 175, 423, 510/434, 476; 134/1
See application file for complete search history.

(56) References Cited

U.S. PATENT DOCUMENTS

| | | | | |
|---|---|---|---|---|
| 6,514,862 | B2 | 2/2003 | Lee et al. | |
| 7,056,829 | B2 | 6/2006 | Bian et al. | |
| 7,416,680 | B2 | 8/2008 | Benning et al. | |
| 7,790,618 | B2 | 9/2010 | Bian | |
| 7,842,192 | B2 | 11/2010 | Bian et al. | |
| 8,025,809 | B2 | 9/2011 | Andreas | |
| 8,314,028 | B2 | 11/2012 | Hong et al. | |
| 2003/0144163 | A1* | 7/2003 | Morinaga et al. | 510/175 |
| 2005/0109980 | A1 | 5/2005 | Wang | |
| 2006/0217280 | A1* | 9/2006 | Scheper et al. | 510/220 |
| 2008/0090500 | A1 | 4/2008 | Hellring et al. | |
| 2009/0031636 | A1 | 2/2009 | Ye et al. | |
| 2009/0104851 | A1 | 4/2009 | Cherian et al. | |
| 2009/0149364 | A1* | 6/2009 | Beck | 510/165 |
| 2009/0202816 | A1 | 8/2009 | Schlenoff | |
| 2009/0312219 | A1* | 12/2009 | Tamura et al. | 510/245 |
| 2011/0318928 | A1 | 12/2011 | Bian | |

* cited by examiner

*Primary Examiner* — Ling Choi
*Assistant Examiner* — Thuy-Ai Nguyen

(57) ABSTRACT

A detergent for cleaning media is provided. The detergent comprises deionized water, between about 1% and about 5% by weight of a nonionic surfactant having an hydrophile/lipophile balance (HLB) value between about 10 and about 20, and an ethoxylation level between about 5 and about 20, between about 1% and about 5% by weight of a dispersing agent, between about 3% and about 10% by weight of a chelating agent comprising phosphonic acid, and between about 2% and about 6% by weight of an inorganic salt.

13 Claims, 3 Drawing Sheets

LOW FOAM MEDIA CLEANING DETERGENT WITH NONIONIC SURFACTANTS

FIELD OF THE INVENTION

The present disclosure generally concerns cleaning processes and detergents used during the manufacturing of disks used in hard drive media, and, more particularly, cleaning processes and detergents used after polishing plated disks.

BACKGROUND OF THE INVENTION

Disks used in hard drive media may include a substrate that is plated with a material such as nickel. After plating, the disks are polished using chemical mechanical polishing. The surfaces of the disks are exposed to contamination from the polish slurry, the polish residue, the manufacturing equipment, and the manufacturing environment. In particular, the polish slurry has a tendency to bond to the surface of the disks making contamination particles from the slurry difficult to remove. If contamination particles are not removed from the surface of the plated polished disk, the operation and performance of hard drive incorporating the disk may be negatively impacted.

SUMMARY OF THE INVENTION

Various embodiments of the present invention solve the foregoing problem by providing a detergent for cleaning media. The detergent comprises deionized water, between about 1% and about 5% by weight of a nonionic surfactant having an hydrophile/lipophile balance (HLB) value between about 10 and about 20, and an ethoxylation level between about 5 and about 20, between about 1% and about 5% by weight of a dispersing agent, between about 3% and about 10% by weight of a chelating agent comprising phosphonic acid, and between about 2% and about 6% by weight of an inorganic salt.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1:
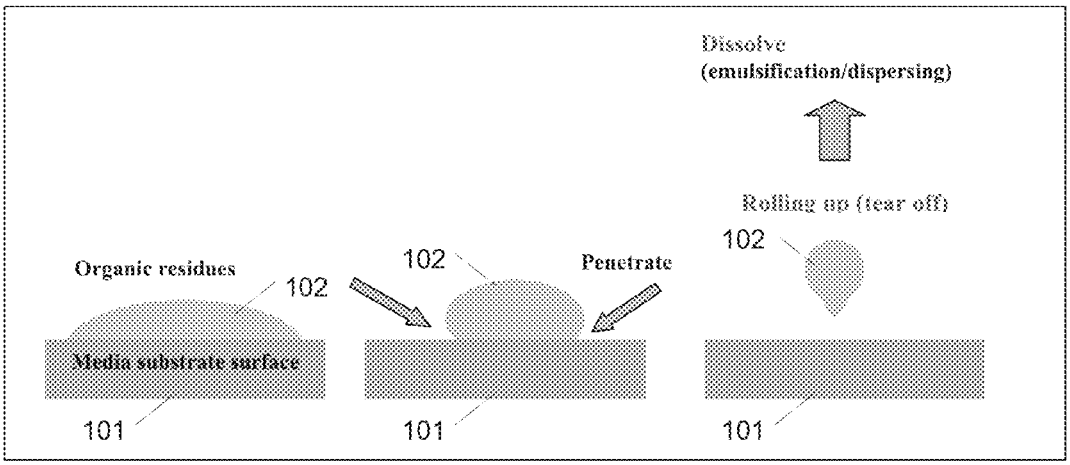
FIG. 1 illustrates the removal of organic residue 102 from a media substrate surface 101, in accordance with one aspect of the subject disclosure.

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

The subject technology provides a post-polish detergent and cleaning process for disks used in hard drive media. Disks used in hard drive media are plated with a material, such as nickel, using a sputtering process. Once the disks have been plated, the disks are polished to provide an even, uniform surface. The plated disks may be polished using chemical mechanical polishing. However, chemical mechanical polishing introduces a number of possible contaminants to the disks. For example, polishing slurry, polish residue, and exposure to the manufacturing environment and machinery all potentially leave contamination particles embedded in the surfaces of the plated disks. Polishing slurry in particular may bond to the disk surfaces making it difficult, if not impossible, to remove using conventional post-polish scrubbing detergents and processes.

The removal of polishing slurry such as aluminum oxide, colloidal silica and organic coolant is usually accomplished by automatic cleaning machines. These machines face difficulties, however, when attempting to remove polishing slurry residues that have dried out on media substrate surfaces. The chemical absorption between the contaminants and the media substrate, together with the poor solubility of organic coolants in traditional detergents are the main culprits when it comes to the poor performance of automatic cleaning machines with traditional detergents. In order to remove contaminants from the media substrates effectively, surfactants may be employed in the detergent to enhance the automatic cleaning machines' performance.

One approach to employing surfactants in a media detergent involves including amine compounds such as monoethnolamine (MEA), diethanolamine (DEA) or mono isopropanolamine (MIPA) in the media detergent formulation. The amine residue that remains on the media substrates after cleaning with these detergent formulations, however, can be vaporized in the subsequent high-temperature sputtering processes. The vapor can then eventually deposit on the sputtering equipment, causing performance deterioration thereof.

According to one aspect of the subject disclosure, to avoid the deposition of amine vapors on manufacturing equipment, an amine-free detergent is provided. To replace the aforementioned amine compounds, a surfactant with at least equivalent cleaning effectiveness on the media substrate is substituted. According to one aspect of the subject disclosure, the detergent includes an alkyl glycoside surfactant.

According to one aspect of the subject disclosure, a detergent for cleaning media is provided. The detergent comprises deionized water, between about 1% and about 5% by weight of a nonionic surfactant having an hydrophile/lipophile balance (HLB) value between about 10 and about 20, and an ethoxylation level between about 5 and about 20, between about 1% and about 5% by weight of a dispersing agent, between about 3% and about 10% by weight of a chelating agent comprising phosphonic acid, and between about 2% and about 6% by weight of an inorganic salt.

According to one aspect of the subject disclosure, the nonionic surfactant may have a molecular weight below about 1200. For example, in accordance with one aspect of the subject disclosure, the nonionic surfactant may comprise a surfactant having the chemical formula R—$(OCH_2CH_2)_n$—OH, where R is an alkyl group of a parent alcohol, and n is a positive integer.

According to one aspect of the subject disclosure, the dispersing agent may comprise a polycarboxylic acid with a molecular weight above about 9000. According to another aspect of the subject disclosure, the chelating agent may comprise a phosphonic acid with a molecular weight of between 200 and 220. For example, in accordance with one aspect of the subject disclosure, the chelating agent may comprise hydroxyethylene disphosphonic acid (HEDP), with the chemical formula $C_2H_8O_7P_2$. The phosphonic acid of the chelating agent may comprise a compound with C—P bonding only. According to another aspect of the subject disclosure, the inorganic salt may comprise potassium hydroxide.

According to one aspect of the subject disclosure, the detergent is substantially free of anionic and cationic surfactants. According to another aspect of the subject disclosure, the detergent is substantially free of amine compounds. According to yet another aspect of the subject disclosure, the detergent has a pH greater than 11. For example, the pH may be maintained at 12.1 through the use of potassium hydroxide, in order to create a desired etching effect on the media substrate surface.

According to various aspects of the subject disclosure, the formulation of the detergent enables it to remove various media contaminants from different sources through different cleaning mechanisms. For example, FIG. 1 illustrates the removal of organic residue 102 from a media substrate surface 101, in accordance with one aspect of the subject disclosure. When substrate surface 101 is soaked in the detergent, the organic residue 102 can be loosened easily. The hydrophobic tail of the nonionic surfactant will attach to organic residue 102 and, at the same time, the opposite force of the hydrophilic head of the surfactant will pull organic residue 102 away from substrate. Once residue 102 has been torn off, micelles in the detergent will keep residue 102 emulsified, suspended and dispersed so it does not redeposit back onto media substrate surface 101 again.

Figure 2:
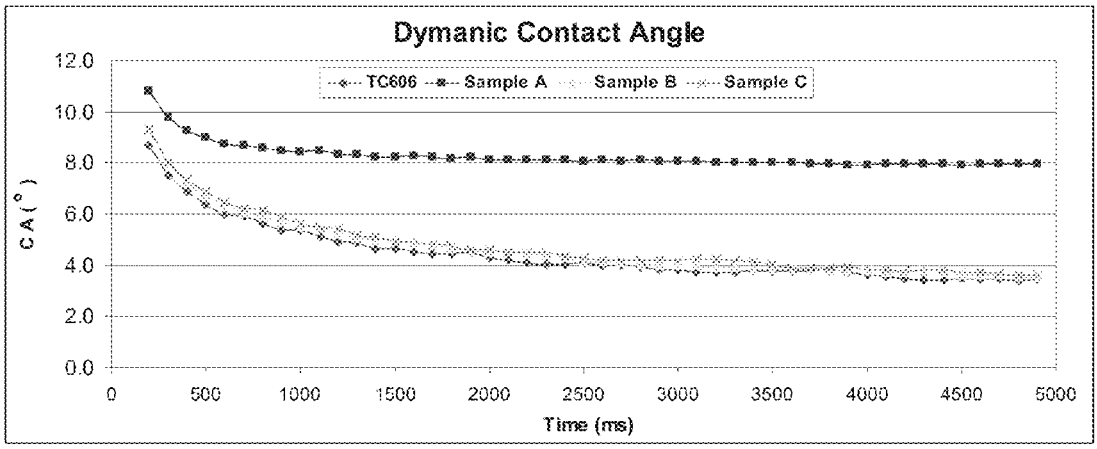
FIG. 2 is a chart illustrating the dynamic contact angle of an improved detergent when compared to other detergent formulations, in accordance with one aspect of the subject disclosure.

The foregoing rolling-up effect is further enhanced because of the dynamic contact angle of the improved detergent is quite low when compared to alternative detergent formulations. For example, in accordance with one aspect of the subject disclosure, the dynamic contact angle may be about 3.8°. The low value of this contact angle indicates that the detergent has almost completed wetted media substrate surface 101. FIG. 2 is a chart illustrating the dynamic contact angle of the improved detergent (labeled as TC606 in the chart) when compared to other detergent formulations, in accordance with one aspect of the subject disclosure. As can be seen with reference to FIG. 2, the improved detergent enjoys a lower dynamic contact angle with a media substrate surface than other formulations.

Figure 3:
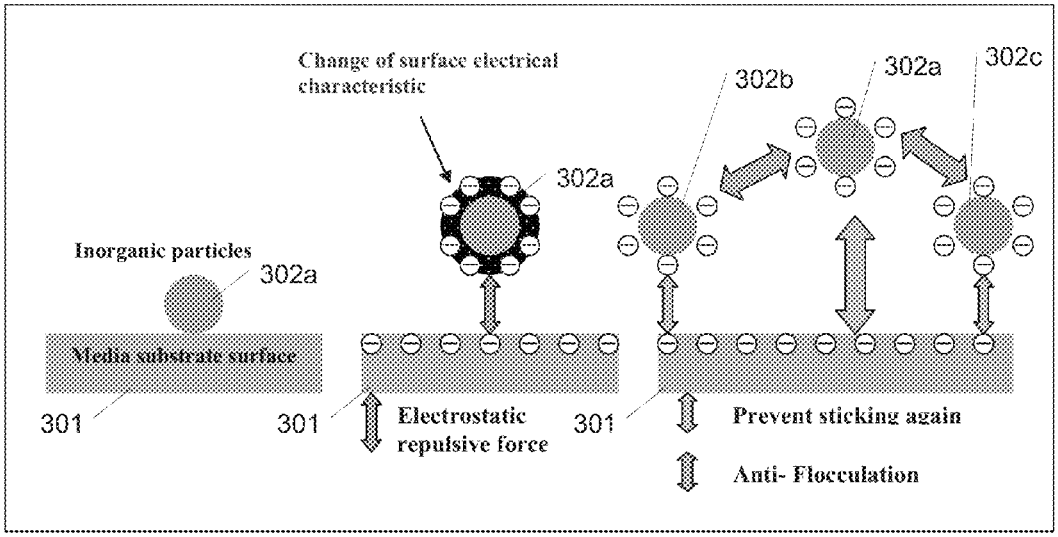
FIG. 3 illustrates the removal of inorganic particles from a media substrate surface, in accordance with one aspect of the subject disclosure.

With respect to inorganic particles, the detergent employs a different mechanism, according to one aspect of the subject disclosure. For example, FIG. 3 illustrates the removal of inorganic particles 302*a*, 302*b* and 302*c* from a media substrate surface 301, in accordance with one aspect of the subject disclosure. In order to remove inorganic particles, such as the alumina and silica used in and left behind by the polishing slurry, the detergent changes the surface electrical charges so that inorganic particles, such as particles 302*a*, 302*b* and 302*c*, are repelled both from media substrate surface 301 and from each other.

Zeta potential is a useful indicator of charge that can be used to predict and control the stability of colloidal suspensions or emulsions. The zeta potential value of the improved detergent formulated according to one embodiment of the present invention has been measured at −33.4 mV at 5% concentration with 1% silica powder. The large magnitude of the zeta potential indicates that the colloidal system with the improved media detergent is stable.

According to one experimental embodiment of the subject technology, the cleaning efficiency of an exemplary improved detergent was compared against other detergent formulations in the cleaning of an exemplary colloidal silica slurry stain. The results are set forth in Table 1, below:

TABLE 1

| | Average Stain Count | Removal % |
|---|---|---|
| Before Cleaning | 38950 | n/a |
| Cleaned by TC606 | 432 | 98.9% |
| Cleaned by Sample A | 608 | 98.4% |
| Cleaned by Sample B | 460 | 98.8% |
| Cleaned by Sample C | 511 | 98.7% |

Figure 4:
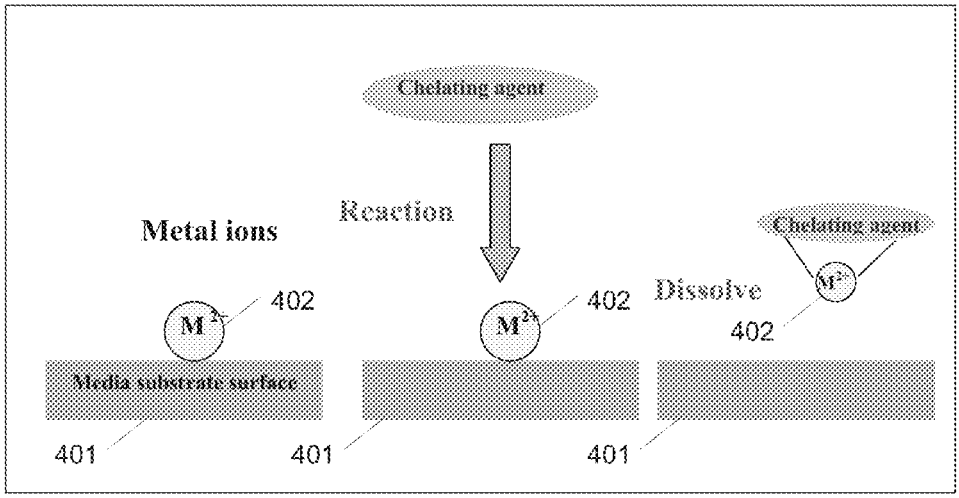
FIG. 4 illustrates the removal of a metal ion from a media substrate surface, in accordance with one aspect of the subject disclosure.

With respect to metal ions, the detergent employs a different mechanism, according to one aspect of the subject disclosure. For example, FIG. 4 illustrates the removal of metal ion 402 from a media substrate surface 401, in accordance with one aspect of the subject disclosure. In order to remove metal ions, the detergent may include a chelating agent, in accordance with one aspect of the subject disclosure. For example, hydroxyethylene disphosphonic acid (HEDP) may be included in the detergent formulation to assist in the removal of many different metal ions, including, for example, $Ca^{2+}$, $Cu^{2+}$, $Fe^{2+}$, $Zn^{2+}$ and $Fe^{3+}$, with which HEDP can form a six-member ring chelate. Moreover, HEDP enjoys good chemical stability under high pH values, and is resistant to being hydrolyzed, due to HEDP's structure including all C—P bonds, rather than the less firm P—O—P bonds found in polyphosphate. According to another aspect of the subject disclosure, the detergent may include any chelating agent which utilizes all C—P bonds, other than HEDP.

To further assist in the removal of inorganic particles, the detergent may include an inorganic salt configured to control the pH, according to one aspect of the subject disclosure. For example, potassium hydroxide may be included to establish a pH of about 12.1, in order to create an etching effect on the substrate surface to be cleaned. In addition to creating the etching effect, maintaining a pH of 12.1 by potassium hydroxide allows the detergent to maintain a repulsive force between the media surface and common inorganic contaminants, such as those listed below on Table 2 with their corresponding iso-electrical point (IEP) value.

TABLE 2

| Inorganic particle | IEP value |
|---|---|
| $SiO_2$ (silica) | 1.7-3.5 |
| $Fe_3O_4$ (magnetite) | 6.5-6.8 |
| $CeO_2$ (ceria) | 6.7-8.6 |
| $Al_2O_3$ (gamma alumina) | 7-8 |
| $Fe_2O_3$ (hematite) | 8.4-8.5 |
| $Al_2O_3$ (alpha alumina, corundum) | 8-9 |
| NiO | 10-11 |

As can be seen with reference to Table 2, to create a repulsive force (i.e., a negative charge) for the listed media contaminants, the pH of media detergent should be set above 11. Excessively high pH values, however, may cause media detergent instability and chemical compatibility issues. According to one aspect of the subject disclosure, therefore, an improved detergent may be configured by the inclusion of an inorganic salt to have a pH value of about 12.1.

One drawback to including an alkyl glycoside surfactant in a media detergent is the generation of undesirable form in the process tank. If foam residue remains on a media substrate after cleaning, it may result in the rejection of the subsequently manufactured disc. Accordingly, a detergent including both an amine free surfactant and a defoaming agent, such as, for example, polyoxethylene phenyl ether, may be provided in accordance with one aspect of the subject invention. According to one aspect of the subject disclosure, the defoaming agent may have the chemical formula R—O—$(C_2H_4O)_n$, where R is a phenyl group, and n is a positive integer.

Figure 5:
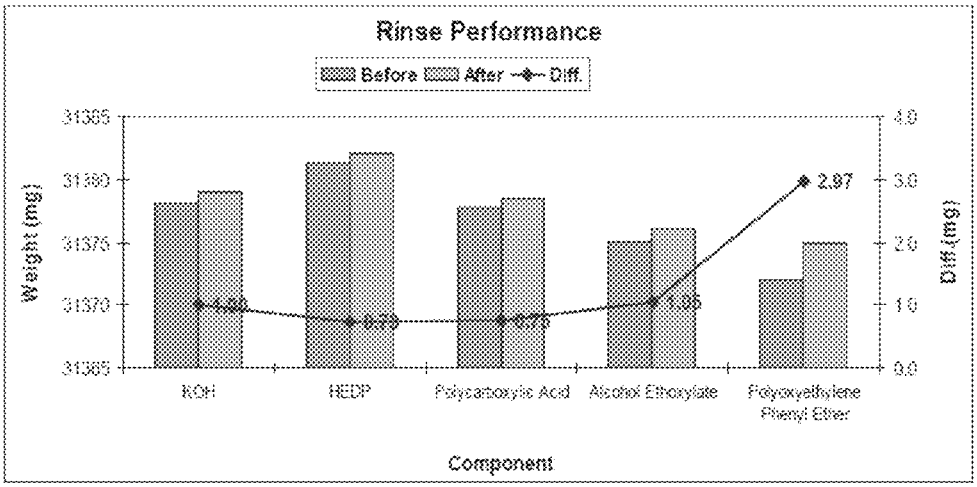
FIG. 5 illustrates the results from independently testing the rinsability of each of the components of one exemplary detergent formulation, using a DI water rinse, in accordance with one aspect of the subject disclosure.

In addition to improved cleaning performance, the improved detergent disclosed herein enjoys improved rinsability, in accordance with one aspect of the subject disclosure. FIG. 5 illustrates the results from independently testing the rinsability of each of the components of one exemplary detergent formulation, using a DI water rinse, in accordance with one aspect of the subject disclosure. As can be seen with reference to FIG. 5, HEDP and polycarboxylic acid can be most easily rinsed away (as evidenced by the low difference), followed by KOH and alcohol ethoxylate. The polyoxethylene phenyl ether is the most difficult chemical component of the exemplary detergent to rinse away. Accordingly, to prevent problems with chemical residue from the polyoxethylene phenyl ether, the concentration of nonionic surfactant in the detergent formulation may be maintained at a low level, such as, for example, between 1% and 5% by weight.

To increase the chemical thermal stability of the detergent formulation, nonionic surfactants with high ethoxylation (EO) levels may be used, in order to increase the cloud point of the detergent to more than 90° C. when in a dilute condition. In an automatic cleaning machine, a high cloud point is desirable, as the tank water temperature for cleaning application can go as high as 60° C. Utilizing a nonionic surfactant with a high EO level, such as, for example, between about 5 and about 20, will assist in preventing cloud formation in these conditions.

Figure 6:
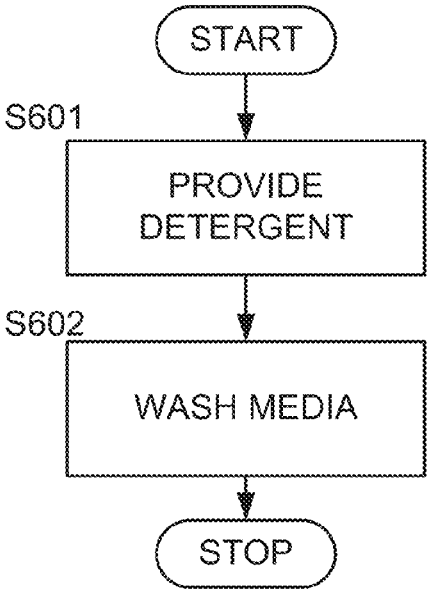
FIG. 6 is a flow chart illustrating a method for cleaning media, in accordance with one aspect of the subject disclosure.

FIG. 6 is a flow chart illustrating a method for cleaning media, in accordance with one aspect of the subject disclosure. The method begins in step 601 by providing a media detergent. The detergent comprises deionized water, between about 1% and about 5% by weight of a nonionic surfactant having an hydrophile/lipophile balance (HLB) value between about 10 and about 20, and an ethoxylation level between about 5 and about 20, between about 1% and about 5% by weight of a dispersing agent, between about 3% and about 10% by weight of a chelating agent comprising phosphonic acid, and between about 2% and about 6% by weight of an inorganic salt. The method continues in step 602, in which the media is washed by the detergent (e.g., by submerging or spraying) to remove contaminants therefrom.

The description of the invention is provided to enable any person skilled in the art to practice the various embodiments described herein. While the present invention has been particularly described with reference to the various figures and embodiments, it should be understood that these are for illustration purposes only and should not be taken as limiting the scope of the invention.

There may be many other ways to implement the invention. Various functions and elements described herein may be partitioned differently from those shown without departing from the spirit and scope of the invention. Various modifications to these embodiments will be readily apparent to those skilled in the art, and generic principles defined herein may be applied to other embodiments. Thus, many changes and modifications may be made to the invention, by one having ordinary skill in the art, without departing from the spirit and scope of the invention.

A reference to an element in the singular is not intended to mean "one and only one" unless specifically stated, but rather "one or more." The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. A detergent for cleaning media, comprising:

water;

between about 1% and about 5% by weight of a nonionic surfactant having an hydrophile/lipophile balance (HLB) value between about 10 and about 20, and an ethoxylation level between about 5 and about 20, wherein the nonionic surfactant is amine-free and comprises a surfactant having the chemical formula R—$(OCH_2CH_2)_n$—OH, where R is an alkyl group of a parent alcohol, and n is a positive integer;

between about 1% and about 5% by weight of a dispersing agent;

between about 3% and about 10% by weight of a chelating agent comprising phosphonic acid; and between about 2% and about 6% by weight of an inorganic salt, wherein the detergent is substantially free of amine compounds and substantially free of anionic and cationic surfactants, and has a pH level of greater than 11, and wherein the chelating agent comprises hydroxyethylene diphosphonic acid (HEDP).

2. The detergent according to claim 1, wherein the nonionic surfactant has a molecular weight below about 1200.

3. The detergent according to claim 1, further comprising a defoaming agent having the chemical formula $RO(C_2H_4O)_nH$, where R is a phenyl group, and n is a positive integer.

4. The detergent according to claim 1, wherein the dispersing agent comprises a polycarboxylic acid with a molecular weight above about 9000.

5. The detergent according to claim 1, wherein the phosphonic acid has a molecular weight of between 200 and 220.

6. The detergent according to claim 1, wherein the inorganic salt comprises potassium hydroxide.

7. A method of cleaning media, comprising:

providing a detergent comprising water;

between about 1% and about 5% by weight of a nonionic surfactant having an hydrophile/lipophile balance (HLB) value between about 10 and about 20, and an ethoxylation level between about 5 and about 20, wherein the nonionic surfactant is amine-free and comprises a surfactant having the chemical formula $R—(OCH_2CH_2)_n—OH$, where R is an alkyl group of a parent alcohol, and n is a positive integer;

between about 1% and about 5% by weight of a dispersing agent;

between about 3% and about 10% by weight of a chelating agent comprising phosphoric acid; and between about 2% and about 6% by weight of an inorganic salt; and washing the media with the detergent to remove contaminants therefrom, wherein the detergent is substantially free of amine compounds and substantially free of anionic and cationic surfactants, and has a pH level of greater than 11, and wherein the chelating agent comprises hydroxyethylene diphosphonic acid (HEDP).

8. The method according to claim 7, wherein the nonionic surfactant has a molecular weight below about 1200.

9. The detergent according to claim 7, further comprising a defoaming agent having the chemical formula $RO(C_2H_4O)_nH$, where R is a phenyl group, and n is a positive integer.

10. The method according to claim 7, wherein the dispersing agent comprises a polycarboxylic acid with a molecular weight above about 9000.

11. The method according to claim 7, wherein the phosphonic acid has a molecular weight of between 200 and 220.

12. The method according to claim 7, wherein the inorganic salt comprises potassium hydroxide.

13. The method according to claim 7, wherein the detergent is maintained at a temperature below about 60° C. during the washing of the media.

* * * * *